US007470104B2

(12) United States Patent
Ishikawa et al.

(10) Patent No.: US 7,470,104 B2
(45) Date of Patent: Dec. 30, 2008

(54) BLOWER

(75) Inventors: Shizu Ishikawa, Chiba (JP); Fumiaki Ishida, Sakura (JP); Satoshi Takeda, Funabashi (JP)

(73) Assignee: Hitachi Industrial Equipment Systems, Co. Ltd., Tokyo (JP)

( * ) Notice: Subject to any disclaimer, the term of this patent is extended or adjusted under 35 U.S.C. 154(b) by 297 days.

(21) Appl. No.: 11/439,268

(22) Filed: May 24, 2006

(65) Prior Publication Data

US 2006/0269394 A1 Nov. 30, 2006

(30) Foreign Application Priority Data

May 27, 2005 (JP) ..... 2005-156305
Nov. 28, 2005 (JP) ..... 2005-341366

(51) Int. Cl.
*F04D 5/00* (2006.01)

(52) U.S. Cl. ..... 415/55.1; 415/55.2; 415/55.3; 415/55.5; 415/182.1

(58) Field of Classification Search ..... 415/55.1, 415/55.2, 55.3, 55.4, 55.5, 55.6, 182.1
See application file for complete search history.

(56) References Cited

U.S. PATENT DOCUMENTS 3,315,607 A * 4/1967 Macinnes ..... 415/55.6
3,720,372 A * 3/1973 Jacobs ..... 415/47
4,923,364 A * 5/1990 Nilsen et al. ..... 415/55.6
5,605,443 A * 2/1997 Schoning et al. ..... 415/214.1
5,925,784 A * 7/1999 Sugiya et al. ..... 562/8
6,086,325 A * 7/2000 Ellinghaus ..... 415/55.4
6,709,243 B1 * 3/2004 Tan et al. ..... 417/244

FOREIGN PATENT DOCUMENTS

| | | |
|---|---|---|
| EP | 0 506 974 | 10/1992 |
| JP | 46-33856 | 4/1971 |
| JP | 58-222996 | 12/1983 |
| JP | 61-207890 | 9/1986 |
| JP | 03-078595 | 4/1991 |
| JP | 2000-291587 | 10/2000 |
| JP | 2003-097486 | 4/2003 |
| WO | WO 92/07191 | 4/1992 |

* cited by examiner

*Primary Examiner*—Igor Kershteyn
(74) *Attorney, Agent, or Firm*—Antonelli, Terry, Stout & Kraus, LLP.

(57) ABSTRACT

A blower comprising: a vane wheel including a pair of grooves, and blades extending in a radial direction of the vane wheel in each groove, and a casing including stationary flow paths facing to the grooves respectively so that the gas urged in the grooves is capable of flowing in a circumferential direction in the stationary flow paths, a guide flow path extending in the axial directions to fluidly communicate with both of the stationary flow paths to enable the gas to flow from one of the stationary flow paths to the other one of the stationary flow paths, an inlet port for introducing the gas into the one of the stationary flow paths facing to the one of the grooves and an outlet port for discharging the gas out of the other one of the stationary flow paths facing to the other one of the grooves.

12 Claims, 16 Drawing Sheets

BLOWER

The present application claims priorities from Japanese applications JP2005-341366 filed on Nov. 28, 2005, JP2005-156305 filed on May 27, 2005, the contents of which are hereby incorporated by reference into this application.

BACKGROUND OF THE INVENTION

The present invention relates to a blower.

Multistage vortex flow blower are disclosed by JP-B2-46-33856, JP-B2-07-117057 and JP-A-03-078595, JP-B2-46-33856 discloses a structure in which one vane wheel performs one stage pressurizing so that a number of stages corresponds to a number of the vane wheels, and JP-B2-07-117057 discloses that a structure of the vane wheels is improved to decrease a number of vanes for each of the stages. JP-A-03-078595 discloses a vane wheel of three-dimensional shape.

BRIEF SUMMARY OF THE INVENTION

FIG. 1 shows an embodiment of vortex flow blower comprising an induction motor 1, a rotary shaft 2 of the induction motor, a stationary flow path of a casing, a vane wheel 4 of the vortex flow blower, a blade casing 4*a* of the vane wheel, and blades 4*b* of the vane wheel 5 denotes the casing, 6 denotes a side cover of the vortex flow blower, and 7 denotes a sound absorber.

The vortex flow blower characterized in that its pressure coefficient as a dimensionless quantity representing a performance per unit vane wheel outer diameter is higher in comparison with a centrifugal blower, can generate a high pressure output with a relatively small outer diameter of the vane wheel while preventing a rotational speed from increasing or at a relatively low rotational speed while preventing an outer diameter of the vane wheel from increasing, whereby it is conventionally used in various fields. For satisfying a requirement of a further increase of the pressure generated by the vortex flow blower, a multi-stage structure in which a plurality of the vane wheels are attached in series on single-rotational shaft to perform pressurizings on respective stages is used.

The multi-stage structure of the vane wheel enables the generated pressure to be increased without increasing the outer diameter of the vane wheel and the rotational speed so that the blower can be downsized and its service life can be extended. Further, since a gas flow rate increases in proportion to cubic value of the outer diameter of the vane wheel, the increase of the generated pressure by the multi-stage structure enables the generated pressure to be increased without increasing the gas flow rate.

As a shape of the vane wheel proposed to obtain a high and stable pressure so that an operating efficiency of the vane wheel and downsizing of the vane wheel are improved, a cup shape such as a half of circle or ellipse of a cross sectional shape of a blade casing of the vane wheel and a three dimensional shape of the vane wheel in which the blade casing has the cup shape of the cross sectional shape, the blades are attached to a rotary shaft with a predetermined angle of them with respect to a radial direction of the rotary shaft and the blades are curved to increase the pressure coefficient, are known (Refer to JP-A-03-078595.)

By inclining the blade shape by the predetermined angle with respect to the radial direction of the rotary shaft, the pressure coefficient as the dimensionless quantity representing a pressure value per unit vane wheel outer diameter and rotational speed is increased, and for example, the pressure coefficient by the three dimensional shape of the vane wheel is 10-20 while the pressure coefficient by a cup shape of the vane wheel in which the blades extend along the radial direction without the inclination is 5-11.

Further, in the vane wheel of blower disclosed by JP-B2-07-117057 having a shape shown in FIG. 7, since the flow pressurized by each of the blades is directed radially outward, a flow passage needs to be formed between an outer periphery of the vane wheel and a stationary flow path so that an outermost diameter of a casing of blower is increased to cause a necessity of improvement of the blade shape for making the size small and the efficiency high.

Since the vane wheel of JP-B2-07-117057 has the outer periphery opening to radially outward although the vane wheel needs to seal the flow between first and second stages formed by the blades and blade casings for the two stages on front and reverse sides of the vane wheel respectively, a protrusion needs to be arranged between the first and second stages on the outer peripheries of the blade casings for the vane wheel to keep a sufficient length of seal structure so that the seal structure 10 needs to be formed by at least three surfaces causing necessities of high precision machining and assembling. Therefore, a cross section of the blade casing as described above is made of cup type to form the two stages of the blades and blade casings on the front and reverse sides of the vane wheel respectively so that the length of the seal structure is elongated and the seal structure of surface type is formed between the outer periphery of the vane wheel and the stationary annular flow path as shown in FIG. 6.

The three dimensional vane wheel as disclosed by JP-A-03-078595 has a high pressure coefficient suitable for making the vane wheel operate for high pressure, but it is made difficult by a shape of blade curving to overlap the blade casing for the three dimensional vane wheel to be produced with monolithically forming the blades through die-casting process, so that the vane wheel including the two stages of the blades and blade casings on the respective front and reverse sides needs to be divided to several pieces to be produced, and whereby its producing cost is made high. Making the three dimensional vane wheel operate for the high pressure is brought about by aligning an intake angle along which the fluid flows onto the blade with a flowing-in angle as shown in FIG. 9 to adjust the flow and increasing a component of discharge velocity of the fluid in a circumferential direction with a curvature of outlet shape with respect to an axial direction. Therefore, for the shape obtainable by the monolithic molding, as shown in FIGS. 8 and 10, a blade inlet angle β1 and an axial inlet angle γ are aligned with the flow to obtain the pressure coefficient 11-16 as an intermediate value between a cup type vane wheel with straight radial shape of no curvature and the three dimensional vane wheel of JP-A-03-078595.

Further, as a problem regarding the multistage vortex flow blower, the pressure ratio changes in accordance with a temperature of an intake side because of an adiabatic compression at each stage so that the pressure ratio decreases in accordance with an increase of the temperature.

The pressure ratio on the adiabatic compression at each stage is calculated along the following formula.

$$\frac{P_2}{P_1} = \left\{\frac{\kappa - 1}{\kappa R T_1} \cdot \eta ad \cdot g \cdot H_{th} + 1\right\}^{(\kappa/\kappa - 1)} \tag{1}$$

P: absolute pressure

T: absolute temperature $H_{th}$: theoretical head

ηad: adiabatic efficiency

R: gas constant

κ: ratio of specific heat (=1.4)

g: gravitational acceleration suffix 1: before compression (intake side)

suffix 2: after compression (discharge side)

As described above, the pressure ratio of the vane wheel with the performance of the theoretical head $H_{th}$, is in inverse proportion to the absolute temperature $T_1$ before compression and decreases in accordance with an increase of the temperature.

Further, in the cycles of the multistage adiabatic compression, if the fluid in an introduction flow path between the stages is cooled to decrease the temperature $T_1$ before compression to be supplied to the stage, a volume efficiency is increased to become generally close to an isothermal compression so that a required power is decreased by single stage compression.

Therefore, cooling the fluid in the introduction flow path for each stage is important to making the operating pressure and efficiency high. As a conventional cooling structure, a cooling fan is arranged to cool an outside of the introduction flow path so that the fluid therein is cooled. But, in this structure, since the fluid passes the introduction flow path at a relatively high speed, a time period in which the cooling fan cools the outside of the introduction flow path and the introduction flow path cools the fluid therein is short so that the fluid is not cooled effectively when a temperature difference is not great.

Accordingly, a cooling utilizing the adiabatic expansion is usable.

From an adiabatic condition, $PV^{\kappa}$=constant (2)

state equation of gas PV=nRT (3)

From the formulas (2) and (3), $T V^{\kappa-1}$ =constant (4)

V: volume n: mole constant

From the above formula (4), the temperature decreases during the expansion, and when an expansion ratio is 1.5, for example, $$V_a/V_b=1.5$$

from the formula (3), $T_b=T_a*(V_a/V_b)^{\kappa-1}=0.85*T_a$ suffix a: before adiabatic expansion (inlet side of introduction flow path)

suffix b: after adiabatic expansion (outlet side of introduction flow path)

so that the temperature decreases after the adiabatic expansion. Further, the flowing speed is decreased by the expansion so that a heat exchange efficiency in the introducing flow path is improved.

Finally, when the pressure increase of one stage is performed by one of the vane wheel of JP-B2-46-33856, and intake directions of the vane wheels are equal to each other, thrust forces generated by differences between the atmosphere pressure and the pressures increased by the vane wheels are equal to each other to be borne by a rotary shaft through the vane wheels so that a bearing structure for bearing the thrust forces is needed. For solving this problem, directions of the pressures generated on the stages of the vane wheels are changed to cancel a total amount of the thrust forces generated by the pressure differences on the drive shaft. The vane wheel including two stages of the blades and blade casings on the front and reverse sides respectively enables the thrust force by the two stages to be halved, and the introduction flow paths for a plurality of the stages are arranged in taking the directions of the thrust forces into consideration as shown in FIG. 13 so that the thrust forces are cancelled to be decreased to zero as shown in FIG. 14.

On the above described problems, an object of the present invention is to provide a blower by which obtainable pressure and cooling performance are increased to make an operating efficiency high in comparison with the prior art.

According to the invention, a blower to be driven by a motor to feed a gas, comprises:

a vane wheel including a pair of grooves extending circularly to surround a rotational axis of the vane wheel and opening in respective axial directions opposite to each other, and blades extending in a radial direction of the vane wheel in each of the grooves to partition the each of the grooves in a circumferential direction of the vane wheel, and a casing on which the vane wheel is supported in a rotatable manner and which includes a pair of stationary flow paths opening in the axial directions respectively and extending in the circumferential direction to face to the grooves respectively so that the gas urged in the grooves is capable of flowing in the circumferential direction in the stationary flow paths, a guide flow path extending in the axial directions to fluidly communicate with both of the stationary flow paths to enable the gas to flow from one of the stationary flow paths to the other one of the stationary flow paths so that the gas urged by one of the grooves is enabled to be further urged by the other one of the grooves, an inlet port for introducing the gas into the one of the stationary flow paths facing to the one of the grooves and an outlet port for discharging the gas out of the other one of the stationary flow paths facing to the other one of the grooves.

If the vane wheel has outer peripheral surfaces each of which overlaps corresponding one of the grooves as seen in the radial direction and faces to the casing in the radial direction to form a close clearance between each of the peripheral surfaces and the casing so that the gas is restrained by the close clearance from flowing along the each of the peripheral surfaces in one of the axial directions from the other one of the stationary flow paths toward the one of the stationary flow paths while the vane wheel is enabled to rotate with respect to the casing, an axial length of the close clearance over the each of the peripheral surfaces can be made great between the pressurizing stages so that the gas is restrained effectively from flowing or leaking from the other one of the stationary flow paths toward the one of the stationary flow paths.

If the vane wheel has outer peripheral surfaces each of which overlaps corresponding one of the grooves as seen in the radial direction and faces to the casing in the radial direction to form the guide flow path between each of the peripheral surfaces and the casing so that the gas is enabled by the guide flow path to flow along the each of the outer peripheral surfaces in one of the axial directions from the one of the stationary flow paths toward the other one of the stationary flow paths, an axial length in which the outer peripheral surfaces contact the gas flow in the guide flow path is made great so that the vane wheel can be effectively cooled by the gas flow in the guide flow path.

If the vane wheel has outer peripheral surfaces each of which overlaps corresponding one of the grooves as seen in the radial direction and faces to the casing in the radial direction, and the outer peripheral surfaces form a common cylindrical shape continuously extending between the outer peripheral surfaces, an axial length in which the outer peripheral surfaces face to the casing to form the close clearance or the guide flow path can be effectively increased. It is preferable that the common cylindrical shape has a constant outer diameter over its entire axial length.

If the vane wheel is arranged to position the other one of the grooves between the motor and the one of the grooves in the axial directions, and the motor has a rotary fan to generate an air flow in one of the axial directions from the other one of the grooves toward the one of the grooves so that the air flow reaches an axial side of the casing adjacent to the other one of the grooves in the axial directions to restrain the air flow from reaching, before reaching the axial side of the casing, the other axial side of the casing opposite to the axial side of the casing in the axial directions, the axial side of the casing whose temperature is higher than the other axial side of the casing can be effectively cooled by the air flow. If the casing has a bearing for supporting the vane wheel on the casing in a rotatable manner, and the bearing is arranged between the motor and the vane wheel in the axial directions, the bearing on the axial side of the casing can be also cooled effectively by the air flow to extend significantly a service life of the bearing.

If the motor has a rotary fan to generate an air flow in one of the axial directions from the motor toward the vane wheel, the casing includes an exhaust silencer connected to the outlet port to absorb sound from the gas discharged from the outlet port, and the exhaust silencer is arranged to be adjacent to the motor, a sound absorbing characteristic of the exhaust silencer is kept constant by cooling the exhaust silencer with the air flow, irrespective of a temperature of the exhausted gas to be treated by the exhaust silencer. It is preferable that the exhaust silencer is a resonance silencer. If at least a part of the exhaust silencer is arranged to overlap at least a part of the motor as seen in a direction perpendicular the axial directions and overlap at least a part of the side of the casing as seen in a direction parallel to the axial directions, the exhaust silencer is further effectively cooled by the air flow.

The blower may comprise another vane wheel juxtaposed to the vane wheel in the axial directions, the another vane wheel includes a pair of grooves extending circularly to surround a rotational axis of the another vane wheel coaxial with the rotational axis of the vane wheel and opening in respective axial directions opposite to each other, and blades extending in a radial direction of the another vane wheel in each of the grooves to partition the each of the grooves in a circumferential direction of the another vane wheel, the casing has another pair of stationary flow paths opening in the axial directions respectively and extending in the circumferential direction to face to the grooves of the another vane wheel respectively so that the gas urged in the grooves of the another vane wheel is capable of flowing in the circumferential direction in the stationary flow paths of the another pair, and another guide flow path fluidly communicating with both of the stationary flow paths of the another pair to enable the gas to flow from one of the stationary flow paths of the another pair facing to one of the grooves of the another vane wheel to the other one of the stationary flow paths of the another pair facing to the other one of the grooves of the another vane wheel so that the gas urged in the one of the grooves of the another vane wheel is enabled to be further urged in the other one of the grooves of the another vane wheel, the inlet port allows the gas to be introduced into the one of the stationary flow paths for the vane wheel, the other one of the stationary flow paths for the vane wheel is fluidly connected to the one of the stationary flow paths of the another pair so that the gas urged in the vane wheel is enabled to be further urged in the another vane wheel, and the outlet port allows the gas to be discharged out of the other one of the stationary flow paths of the another pair through the other one of the stationary flow paths for the vane wheel.

If the vane wheels are arranged in the axial directions to position the other one of the grooves of the vane wheel and the one of the grooves of the another vane wheel between the one of the grooves of the vane wheel and the other one of the grooves of the another vane wheel in the axial directions, an axial or thrust force to be borne by bearing is halved in comparison with a total amount of thrust forces generated on the vane wheels by respective pressuring stages.

If the vane wheels are arranged in the axial directions to position the other one of the grooves of the vane wheel and the other one of the grooves of the another vane wheel between the one of the grooves of the vane wheel and the one of the grooves of the another vane wheel in the axial directions, or the vane wheels are arranged in the axial directions to position the one of the grooves of the vane wheel and the one of the grooves of the another vane wheel between the other one of the grooves of the vane wheel and the other one of the grooves of the another vane wheel in the axial directions, an axial or thrust force to be borne by bearing is made substantially zero in comparison with a total amount of thrust forces generated on the vane wheels by respective pressuring stages.

If the vane wheels are arranged to position the other one of the grooves of the another vane wheel between the motor and the one of the grooves of the another vane wheel in the axial directions and to position the another vane wheel between the motor and the vane wheel in the axial directions, and the motor has a rotary fan to generate an air flow in one of the axial directions from the other one of the grooves of the another vane wheel toward the one of the grooves of the another vane wheel so that the air flow reaches an axial side of the casing adjacent to the another vane wheel in the axial directions to restrain the air flow from reaching, before reaching the axial side of the casing, the other axial side of the casing opposite to the axial side of the casing in the axial directions, the final pressurizing stage adjacent to the axial side of the casing can be effectively cooled by the air flow to prevent an excessive temperature increase of the blower.

If the blower comprises a rotary fan rotatable with the vane wheel and the another vane wheel and arranged between the vane wheel and the another vane wheel in the axial directions to urge an air toward at least one of a part of the casing facing to at least one of the vane wheel and the another vane wheel in the axial directions and another part of the casing including a flow passage extending in the axial directions to enable the other one of the stationary flow paths for the vane wheel to be fluidly connected to the one of the stationary flow paths of the another pair, the gas pressurized by an upstream side pressurizing stage to be heated is cooled by the urged air to decrease a temperature of the gas to be taken into an downstream side pressurizing stage so that an operating efficiency of the blower is increased, and the casing and/or the vane wheel(s) is cooled to prevent a thermal deterioration of the casing and/or the vane wheel(s) caused by the pressurized high temperature gas.

It is effective for cooling the gas pressurized and heated by an upstream side pressurizing stage to decrease a temperature of the gas to be taken into an downstream side pressurizing stage, that a flow passage is defined by the one of the grooves and the one of the stationary flow paths to pressurize the gas in the flow passage by rotating the vane wheel, and a cross sectional area of the flow passage along an imaginary plane along which the rotational axis of the vane wheel extends is smaller than a cross sectional area of the guide flow path as seen-in the axial directions to enable the gas pressurized in the flow passage to expand adiabatically in the guide flow path so that a temperature of the gas to be taken into the other one of the stationary flow paths decreases in the guide flow path, that a flow passage is defined by the other one of the grooves of the vane wheel and the other one of the stationary flow paths for the vane wheel to pressurize the gas in the flow passage by rotating the vane wheel, the casing includes a flow path extending in the axial directions to fluidly connect the other one of the stationary flow paths for the vane wheel to the one of the stationary flow paths of the another pair, and a cross sectional area of the flow passage along an imaginary plane along which the rotational axis of the vane wheel extends is smaller than a cross sectional area of the flow path as seen in the axial directions to enable the gas pressurized in the flow passage to expand adiabatically in the flow path so that a temperature of the gas to be taken into the one of the stationary flow paths of the another pair decreases in the flow path, that an effective cross sectional area for gas flow through the one of the stationary flow paths facing to the one of the grooves and an effective cross sectional area for gas flow through an outlet port of the one of the stationary flow paths are smaller than an effective cross sectional area for gas flow through the guide flow path to enable the gas pressurized by the one of the grooves to expand adiabatically in the guide flow path so that a temperature of the gas to be taken into the other one of the stationary flow paths decreases in the guide flow path, and/or that the casing includes a flow path for fluidly connecting the other one of the stationary flow paths for the vane wheel to the one of the stationary flow paths of the another pair, and an effective cross sectional area for gas flow through the other one of the stationary flow paths for the vane wheel facing to the other one of the grooves of the vane wheel and an effective cross sectional area for gas flow through an outlet port of the other one of the stationary flow paths for the vane wheel are smaller than an effective cross sectional area for gas flow through the flow path to enable the gas pressurized by the other one of the grooves of the vane wheel to expand adiabatically in the flow path so that a temperature of the gas to be taken into the one of the stationary flow paths of the another pair decreases in the flow path.

Other objects, features and advantages of the invention will become apparent from the following description of the embodiments of the invention taken in conjunction with the accompanying drawings.

DETAILED DESCRIPTION OF THE INVENTION

A best mode for bringing the invention into effect is explained.

Hereafter, a structure of embodiment of a blower of the invention will be explained in detail with drawings.

Figure 1:
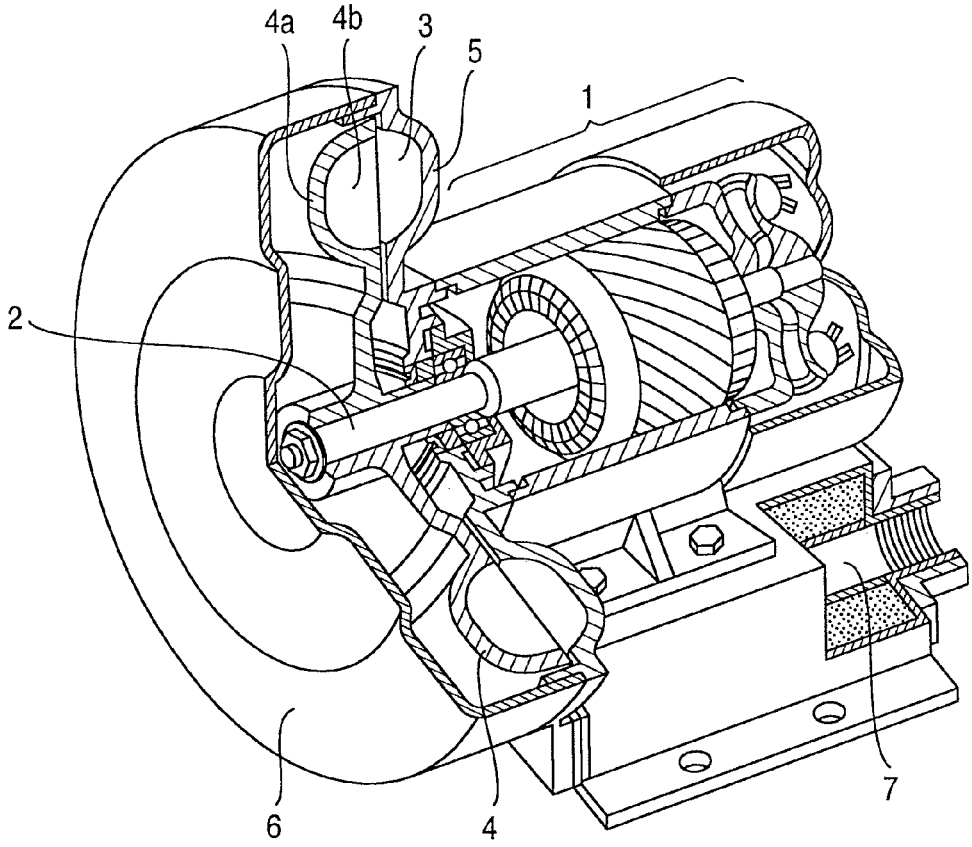
FIG.1 BACKGROUND ART
FIG. 1 is an explanation view showing a structure of a vortex flow blower of single stage.
Figure 2:
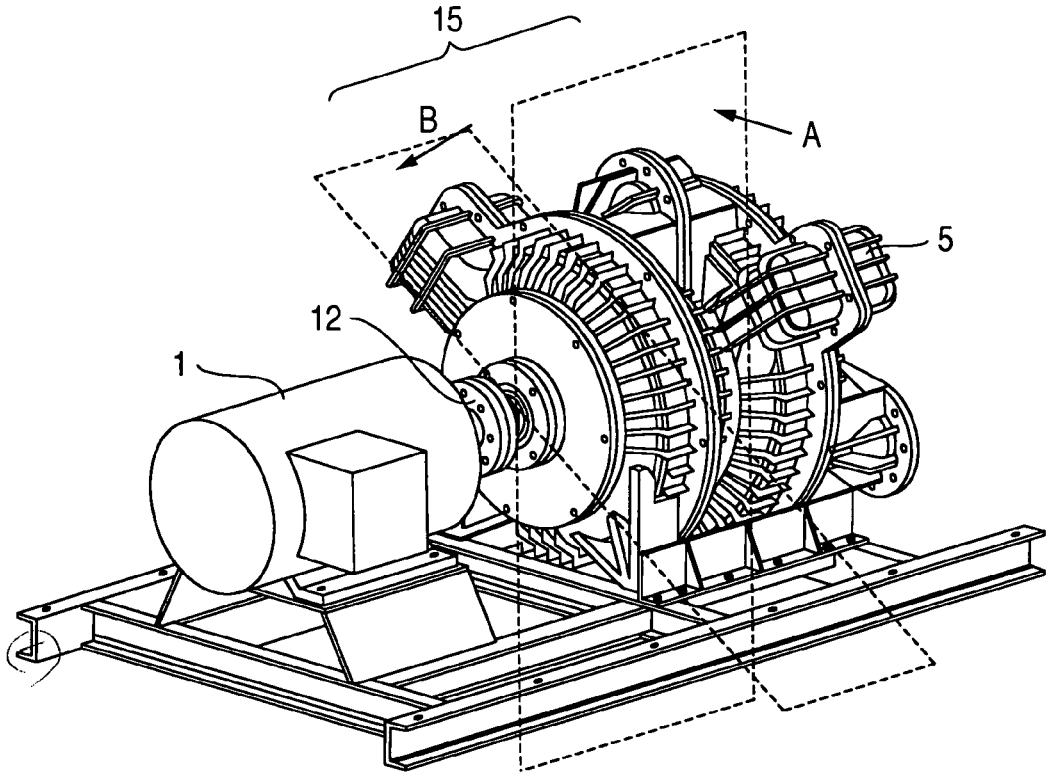
FIG. 2 is an explanation view showing a structure of an embodiment of a vortex flow blower of multistage.
Figure 3:
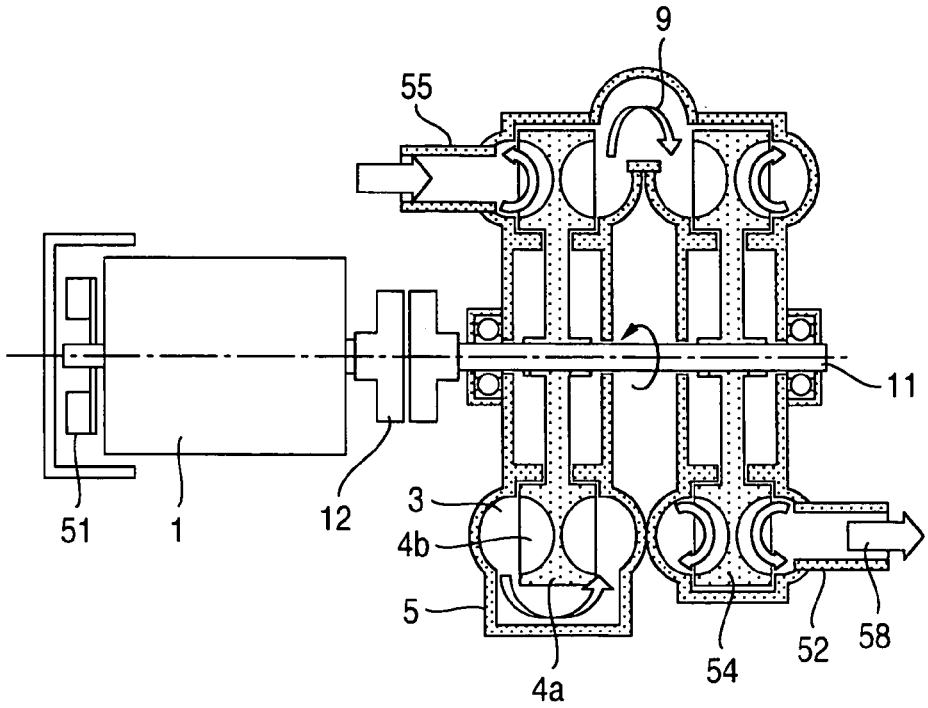
FIG. 3 is a cross sectional view of a blower area of the embodiment of the vortex flow blower of multistage as seen in A direction in FIG. 2 as a cross sectional explanation view of vane wheels and a casing including stationary flow paths and an introduction flow path 9.

Embodiment 1 is explained. In FIG. 2, a case in which two vane wheels for a multistage vortex flow flower of the embodiment perform four pressurizing stages is shown. FIG. 3 is a cross sectional view of the blower part as seen in A direction in FIG. 2 as a cross section of the vane wheels including blades 4*b* and blade casings 4*a*, stationary flow paths 3 and introduction flow paths 9. Since a rotary shaft 11 is elongated for the vane wheels of multistage in the embodiment shown in FIG. 2, an electric motor 1 as driving source and the rotary shaft 11 of blower are connected to each other by a driving force transmitting part such as a coupling. If a strength of the shaft is sufficient, it may be directly connected to a shaft of the electric motor. Further, the driving source may include a rotary machine such as engine other than the electric motor 1. The vane wheel as shown in FIG. 3 includes two stages of the blades 4*b* and blade casings 4*a* on front and reverse sides respectively to perform the two stages pressurizing, and a seal structure is formed between an outer periphery of the vane wheel and the casing. The fluid pressurized at each of the stages is introduced through the introduction path 9 to next one of the stages to be further pressurized. When the stages from first stage to fourth stage are connected in order by the introduction paths 9, since a thrust force generated by a pressure difference with respect to the atmosphere is halved by forces on the first and second stages on the respective front and reverse sides of each of the vane wheels whose directions are opposite to each other, a total amount of the thrust forces to be borne by the rotary shaft 11 is a half of the force generated by the pressures in the blower.

Figure 4:
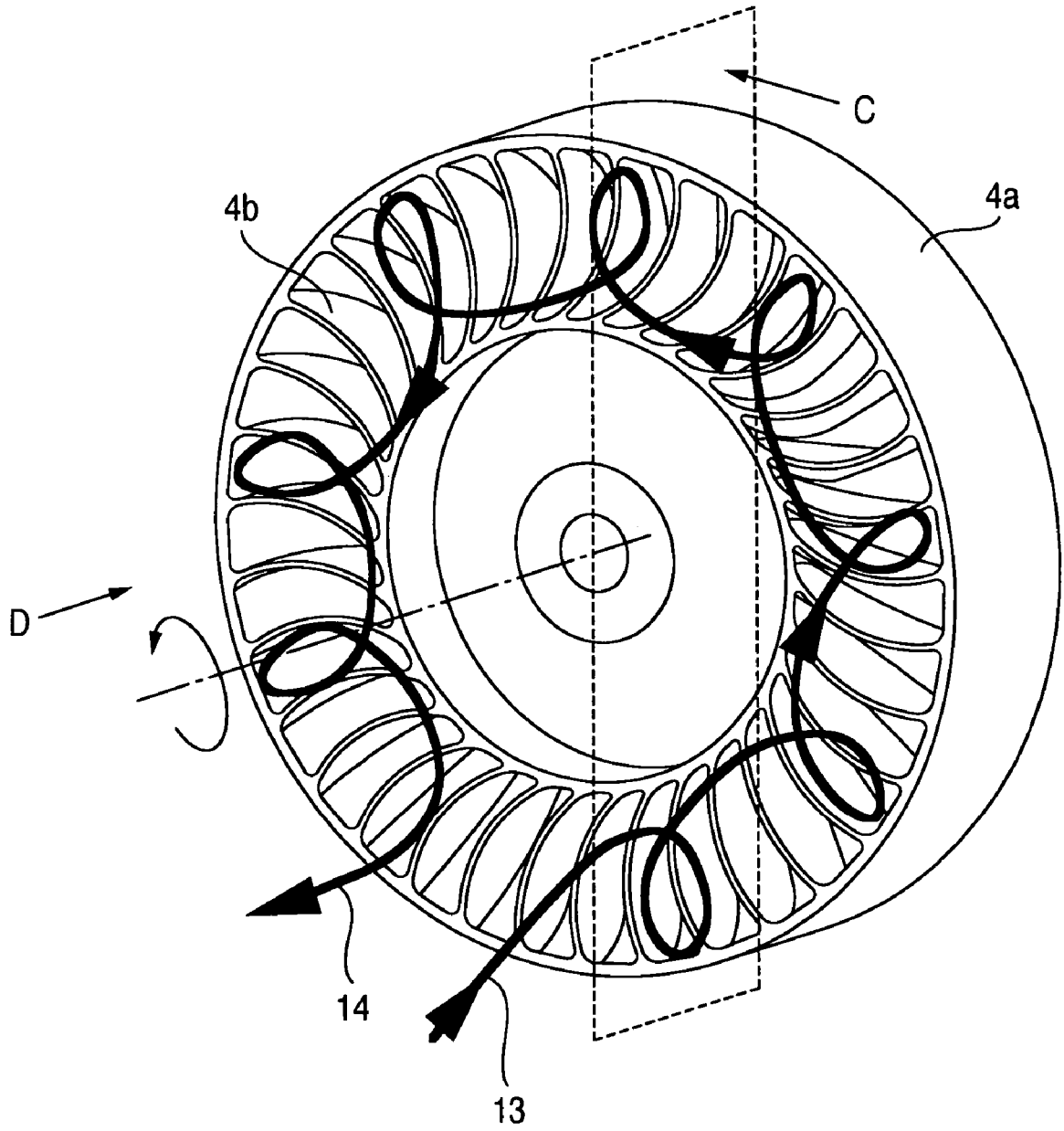
FIG. 4 is a view for explaining the vane wheel used in the embodiment of the vortex flow blower of multistage and a flow on the vane wheel.
Figure 5:
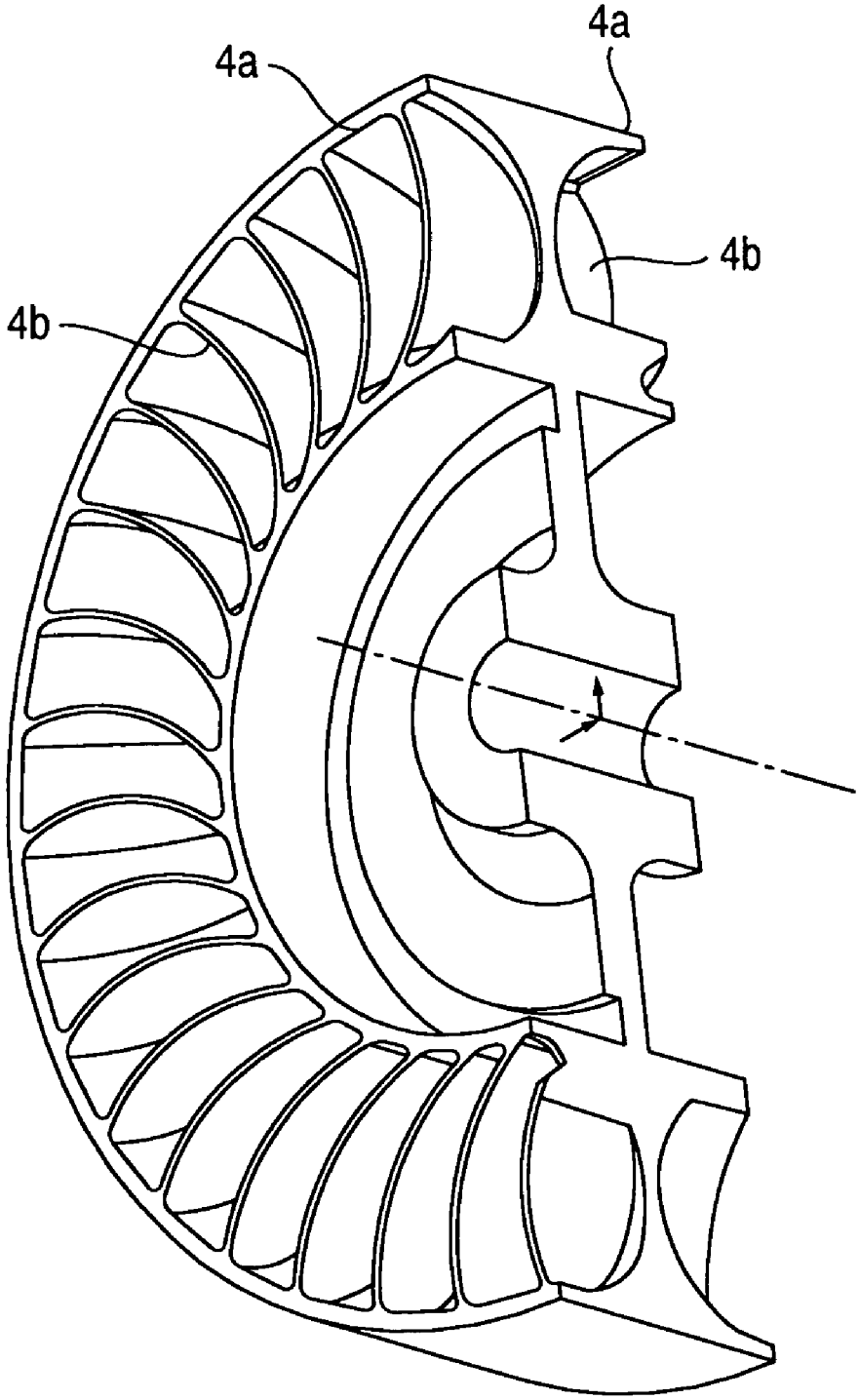
FIG. 5 is a cross sectional view of the vane wheel as seen in C direction in FIG. 4 as an explanation view of the blades and blade casing on a reverse side.
Figure 6:
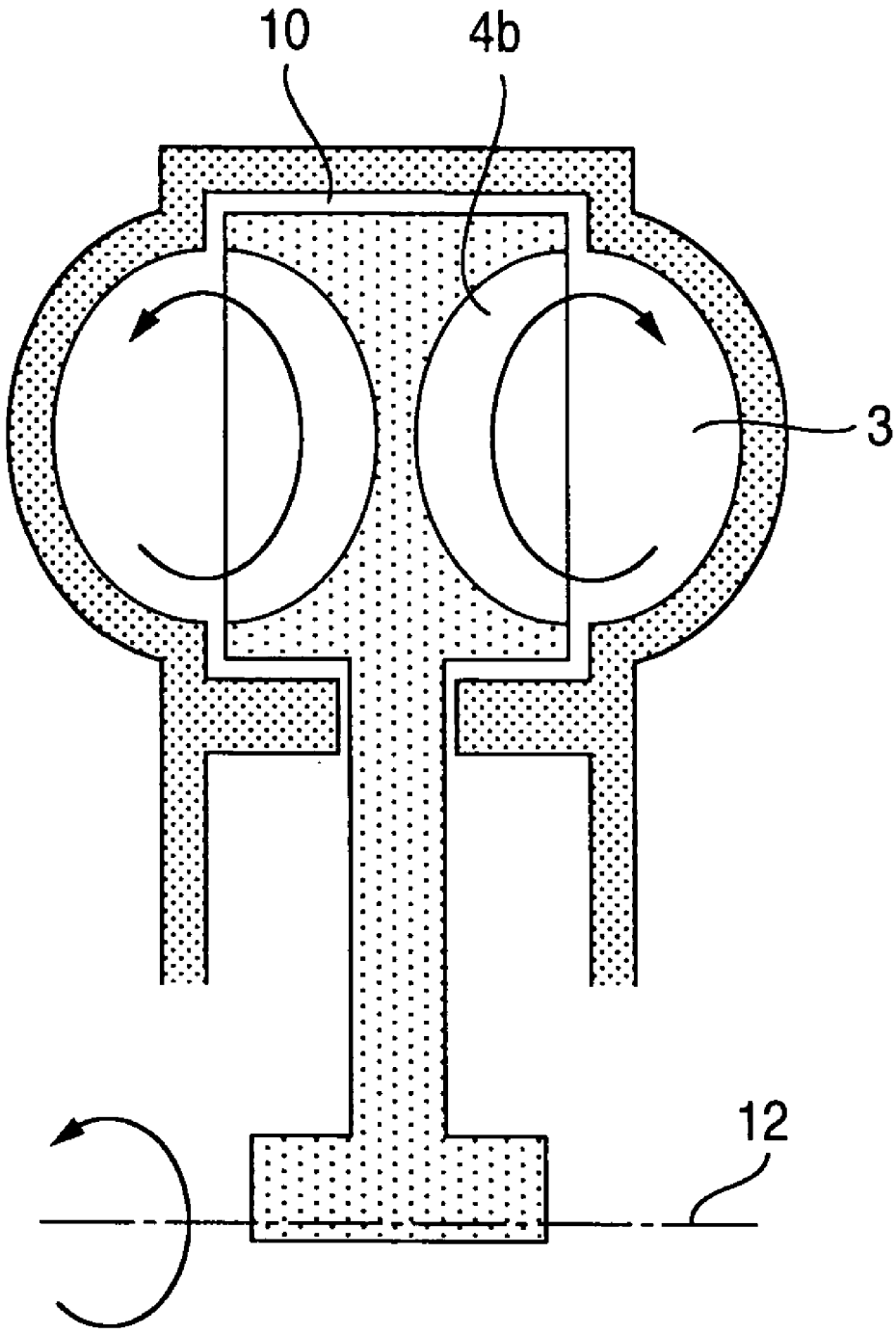
FIG. 6 is an explanation view of typical cross sectional model of the vane wheel used in the embodiment of the vortex flow blower of multistage as seen in C direction in FIG. 4.
Figure 7:
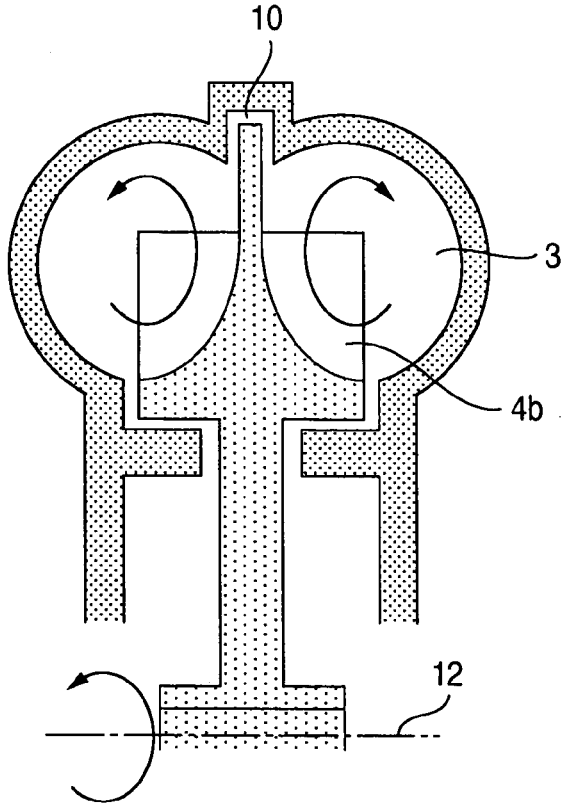
FIG. 7 is a view as a typical cross sectional model showing a difference between a vane wheel used for the vortex flow blower and the shape of FIG. 6 as seen in a direction identical to that of FIG. 6.
Figure 10:
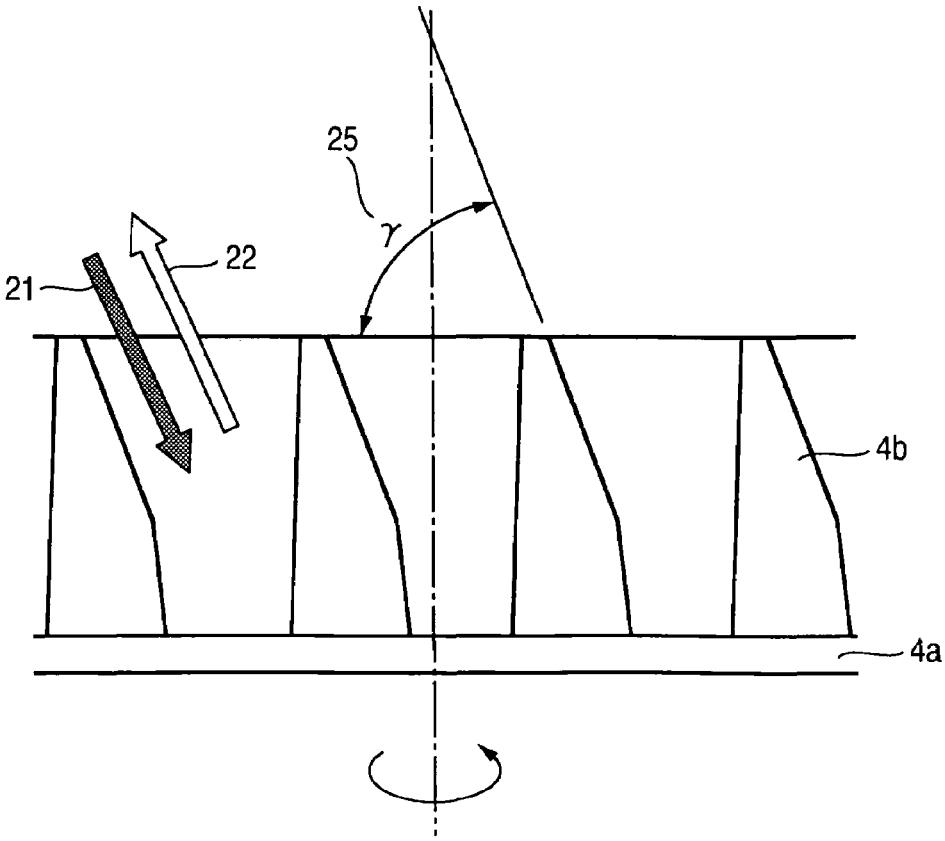
FIG. 10 is a view for explaining physically the shape of the blade as seen in E direction in FIG. 8.

FIG. 4 is a vane wheel used for the multistage vortex flow blower of the embodiment, and FIG. 5 is a cross sectional view of the vane wheel as seen in C direction in FIG. 4. FIG. 6 is an enlarged view showing the blades 4*b* of the vane wheel as seen in D direction in FIG. 4, and FIG. 10 shows typically the shape of the blades 4*b* as seen in E direction. The blade casing 4*a* of the vane wheel has a cup shape as a half of circular or elliptical shape as shown in FIG. 4, and the two stages of the blades 4*b* and blade casings 4*a* are arranged on the respective front and reverse sides of each of the vane wheels for the two. stages pressurizing as shown in FIG. 5.

Figure 19:
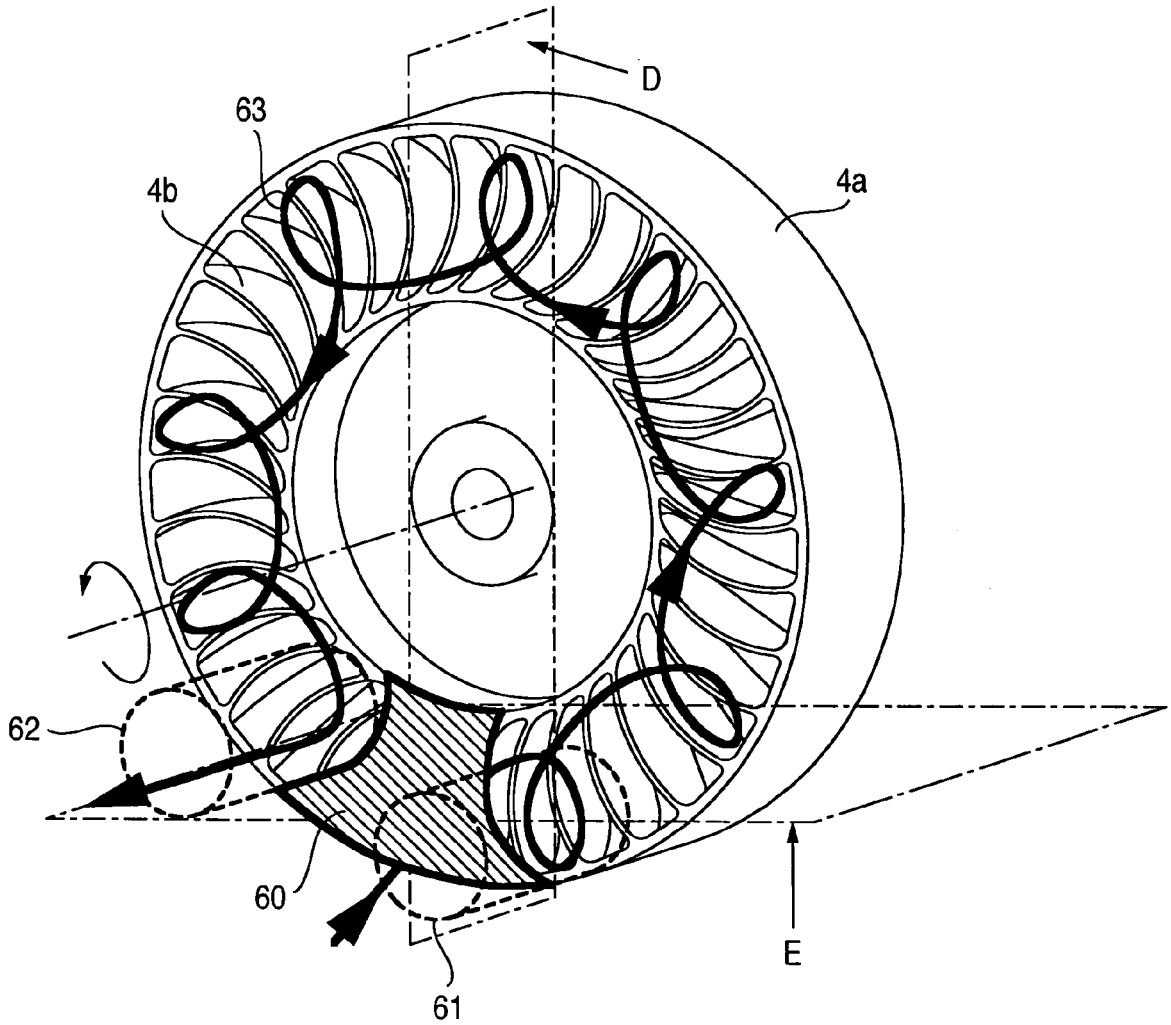
FIG. 19 is an oblique projection view showing the vane wheel of the invention and a flow of the fluid between inlet port 61 and outlet port 62 of the stationary flow path isolated fluidly from each other by a partition wall 60.
Figure 20:
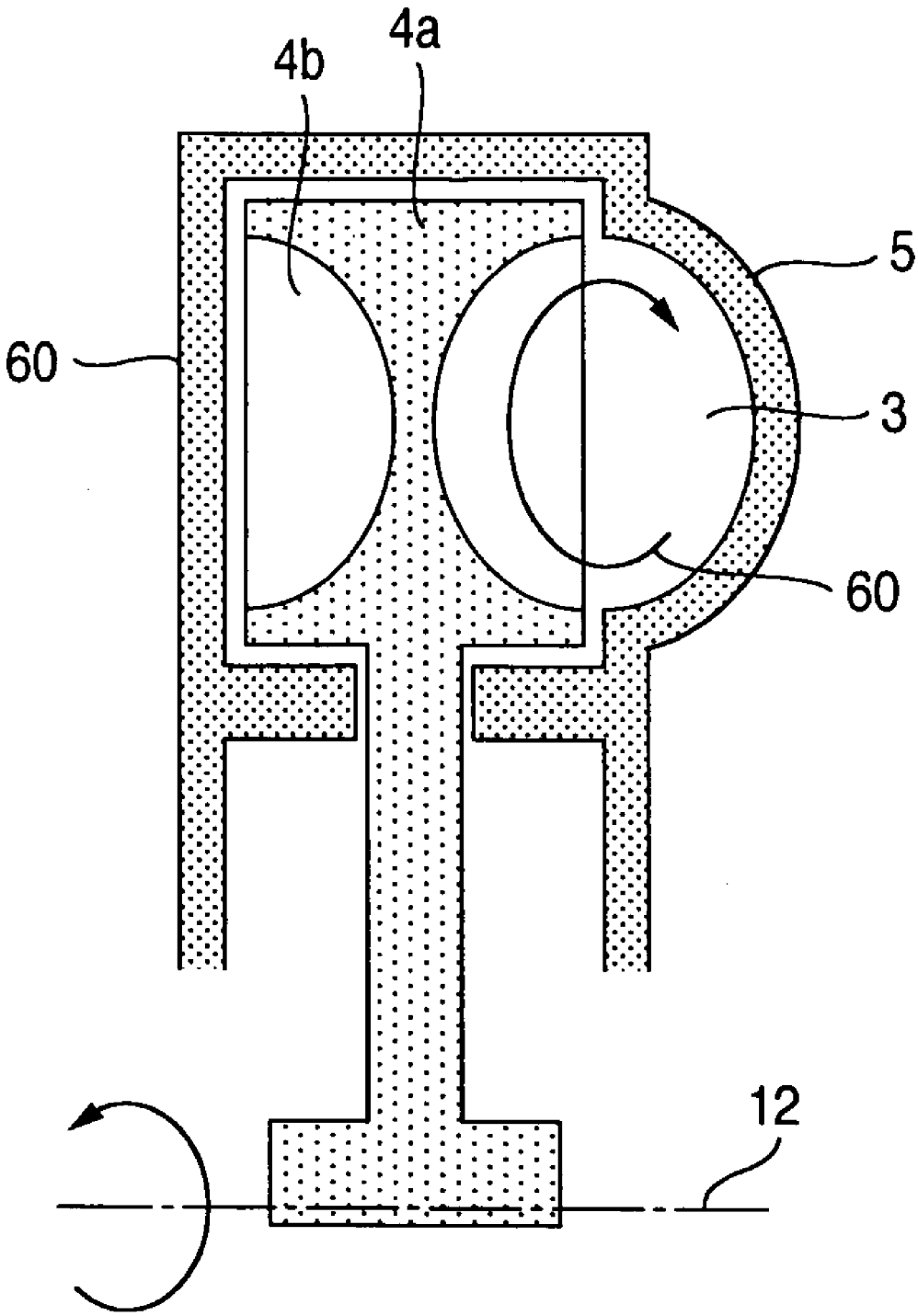
FIG. 20 is a cross sectional view as seen in D direction in FIG. 19 to show the partition wall 60 facing axially to the vane wheel.
Figure 21:
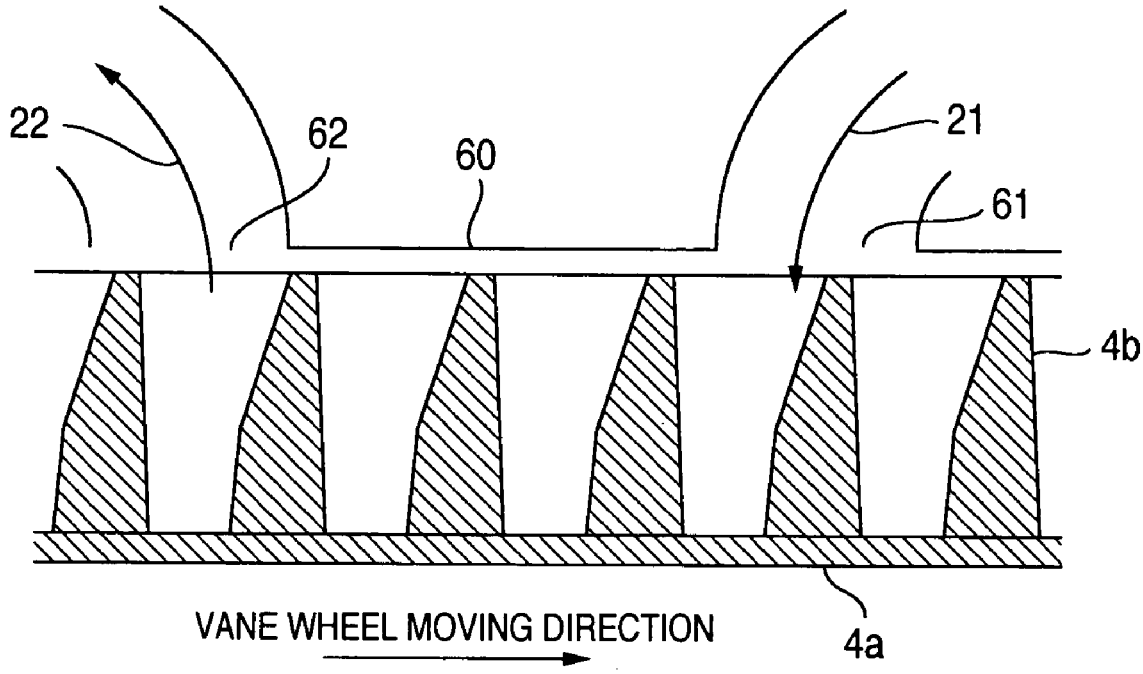
FIG. 21 is a cross sectional view taken along a circumferential direction and straightened to show the partition wall 62 facing radially to the vane wheel and show the inlet port 61 or outlet port 62 of the stationary flow path for the vane wheel opening radially to a flow passage communicating fluidly with the stationary flow path for the other vane wheel or the other stationary flow path of the vane wheel.
Figure 22:
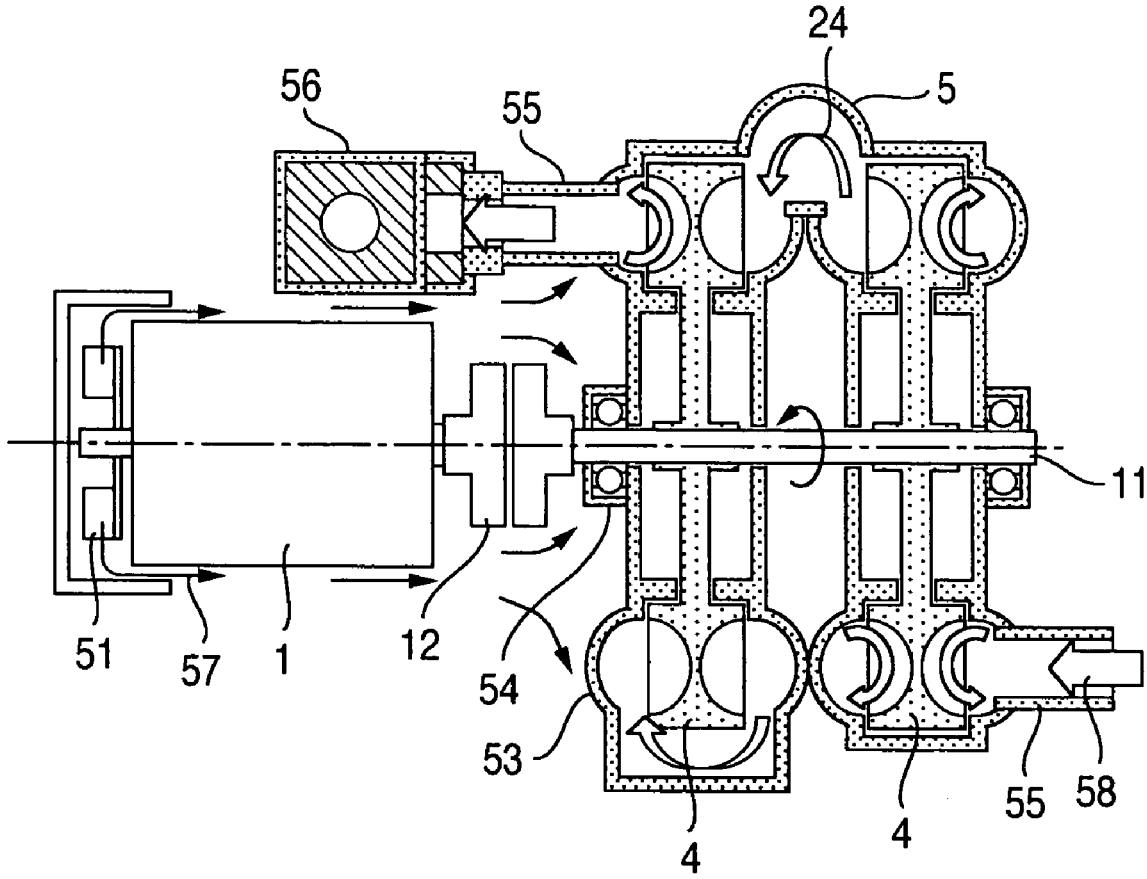
FIG. 22 is a cross sectional view showing an embodiment in which the final pressurizing stage and the discharge port of the casing are arranged at the electric motor side, and the silencer is directed to discharge the fluid in a direction perpendicular to a rotational axis of the motor and vane wheel.
Figure 23:
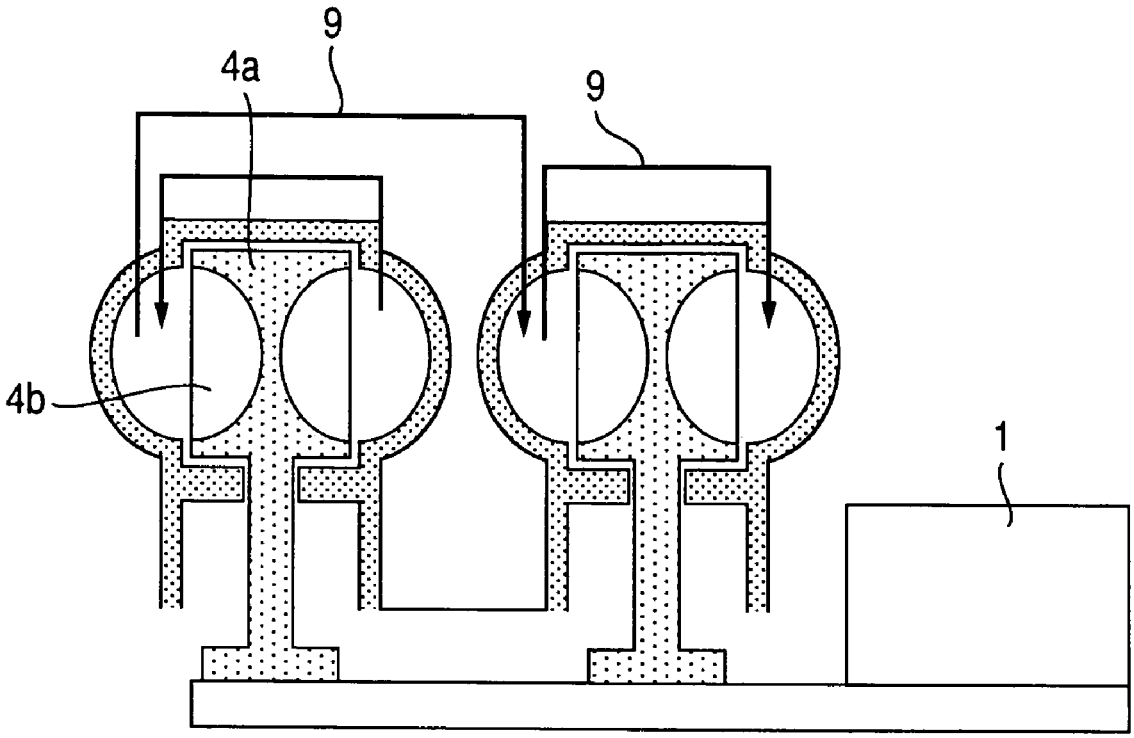
FIG. 23 is a cross sectional view showing another embodiment of the invention including another arrangement of flow passages for connecting fluidly the stationary flow paths of the vane wheel to each other, connecting fluidly the stationary flow paths of the another vane wheel to each other, and connecting fluidly the stationary flow path of the another vane wheel and the stationary flow path of the vane wheel to each other.

Undesired sound of the blower is mainly composed of a rotating sound generated by an interference between the vane wheel and the partition wall 60 of the casing isolating fluidly the inlet port 61 to the vane wheel and the outlet port 62 from the vane wheel as shown in FIG. 19. The sound by interference is generated by, as shown in FIG. 21, a pressure variation caused by an impingement between the partition wall and a highly pressurized flow 22 from the vane wheel, and the smaller a distance between the partition wall and the blade 4*b* of the vane wheel is, the greater the sound is. A frequency of the rotating sound generated by the interference with respect to the partition wall is a product of a number of the blades 4*b* and a rotating frequency. Therefore, since the rotating sound is great when the blades 4*b* on the first and second stages are arranged to cause the simultaneous interference between the partition wall and the blades 4*b* on the first and second stages, the blades 4*b* on the first and second stages are arranged to be shifted from each other to prevent the simultaneous interference between the partition wall and the blades 4*b* on the first and second stages as shown in FIG. 5.

Figure 8:
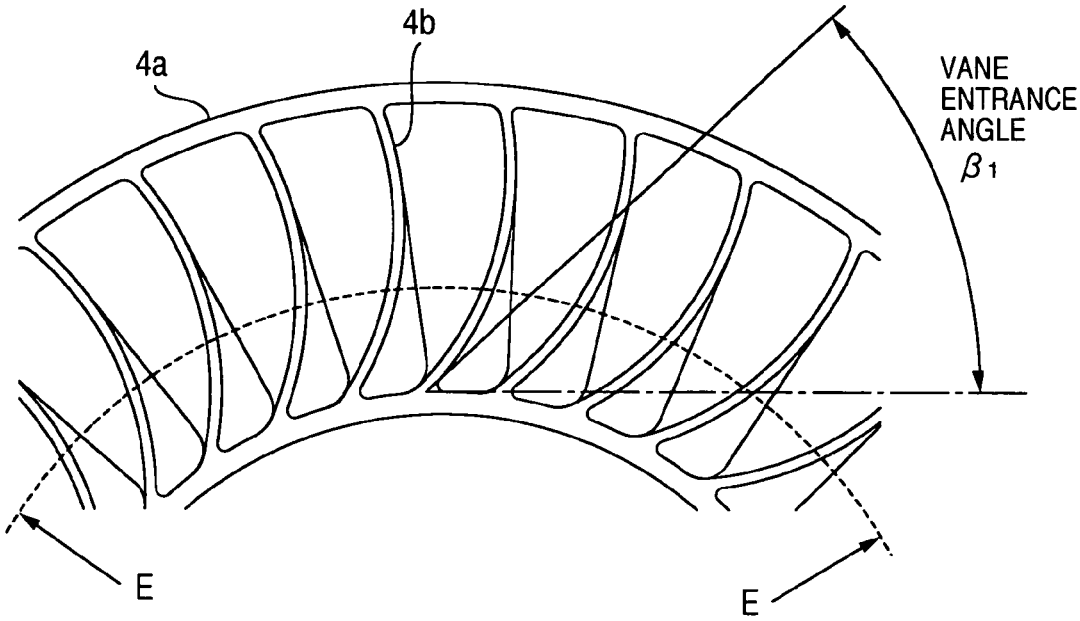
FIG. 8 is an enlarged view showing blade area of the vane wheel as seen in D direction in FIG. 4.
Figure 9:
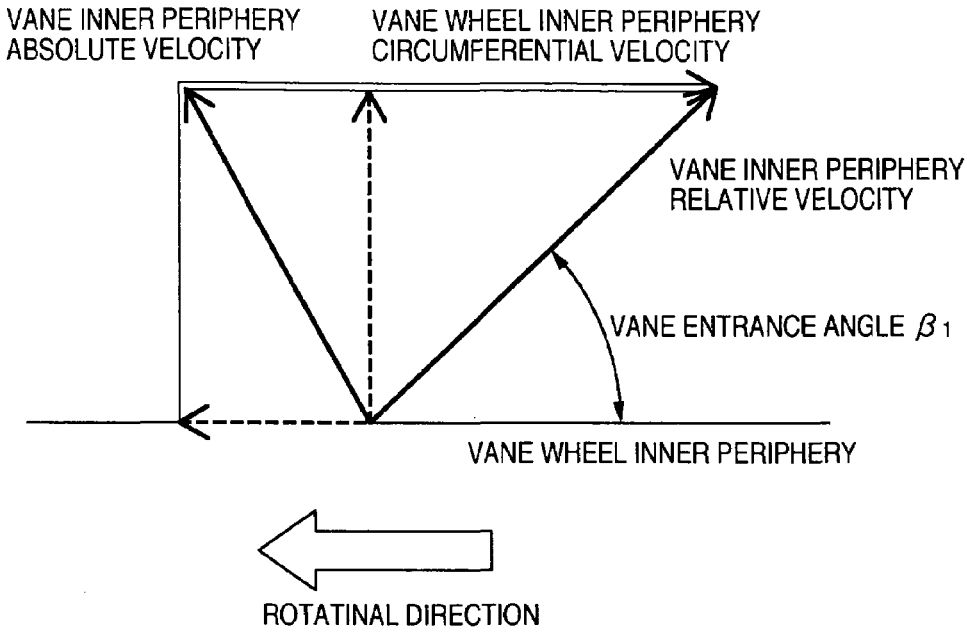
FIG. 9 is a view for explaining physically the shape of the blade shown in FIG. 8.

As shown in FIG. 8, the blades 4*b* of the vane wheel are curved backward with respect to a rotational direction, and an entrance angle β1 has a predetermined angle fitting with an introducing angle of the fluid with respect to a plane perpendicular to the rotary shaft 11. Further, an entrance shape of the blades 4*b* is inclined with respect to an axial direction to fit with an axial flowing-in angle as shown in FIG. 10.

Figure 11:
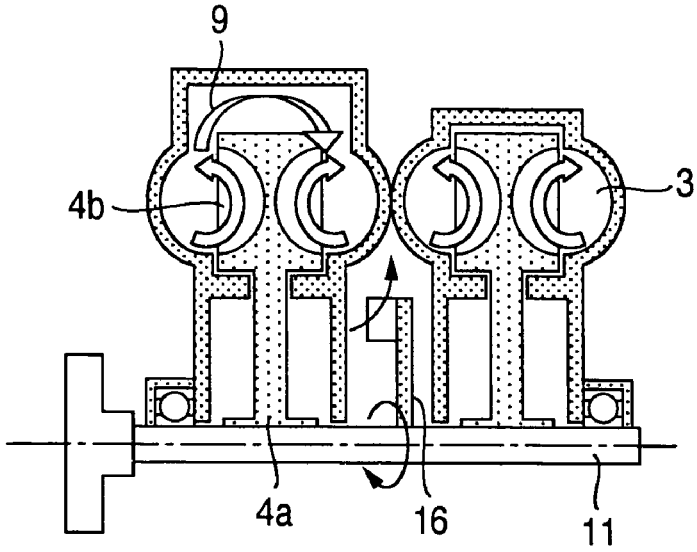
FIG. 11 is a cross sectional view showing the blower part of the embodiment of the vortex flow blower of multistage as seen in B direction in FIG. 2 as a cross sectional explanation view of a casing including the stationary flow paths and introduction flow path 9 and a rotary fan 16 rotatable with the vane wheel to generate an air flow to a part of the casing facing axially and/or radially to the vane wheel.
Figure 12:
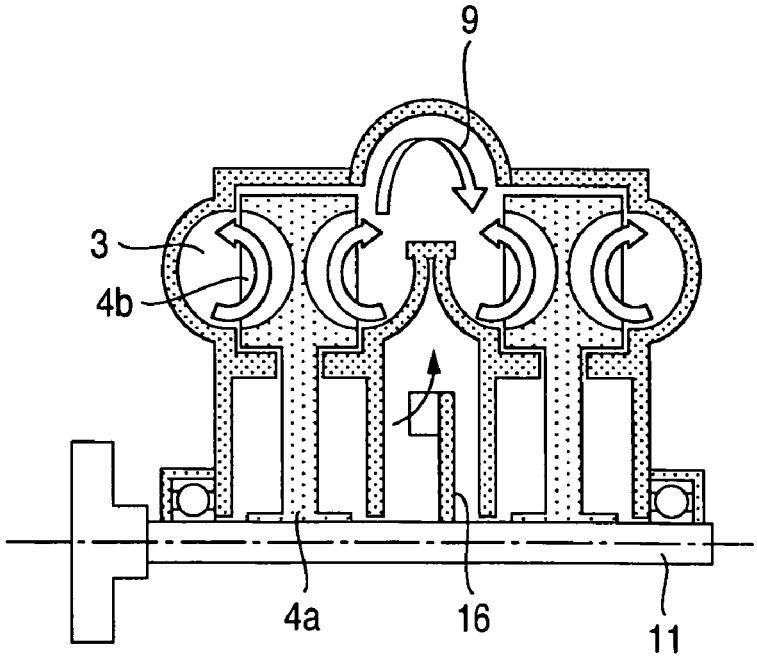
FIG. 12 is a cross sectional view showing the blower part of the embodiment of the vortex flow blower of multistage as seen in A direction in FIG. 2 as a cross sectional explanation view of the casing including the stationary flow paths and introduction flow path and the rotary fan 16 rotatable with the vane wheel to generate the air flow to a part of the casing facing axially and/or radially to the vane wheel and another part of the casing including an axial flow passage communicating fluidly with the stationary flow paths for the respective vane wheels.

FIG. 11 is a cross sectional view of the blower part of the embodiment of the multistage vortex flow blower as seen in B direction in FIG. 2, and FIG. 12 is a cross sectional view of the blower part of the embodiment of the multistage vortex flow blower as seen in A direction in FIG. 2, so that a cross section of the casing including the stationary flow paths and introduction paths 9 and a cross section of a cooling fan arranged between the second and third stages are shown. The shape of the introduction path 9 for introducing the fluid pressurized in the first stage to the second stage on the two stages on the respective front and reverse sides of the vane wheel is shown in FIG. 11, and the shape of the introduction path 9 for introduction from the second stage to the third stage of the another vane wheel is shown in FIG. 12. Both of the introduction paths 9 have cross sectional areas greater than a cross sectional area of the stationary flow path and an area of outlet port connected to the introduction path 9 so that a temperature of the fluid after passing the introduction path 9 is decreased by an adiabatic expansion caused by enlarging the cross section of the introduction path 9 connecting the stages with respect to the upstream and downstream stationary flow paths to restrain a pressure ratio from being decreased in the next stage. Further, a decrease in velocity of the fluid by the expansion makes a time period of heat exchange in the introduction path 9 longer to enable a cooling fan to perform the cooling effectively. Therefore, a cooling effect is increased.

Figure 13:
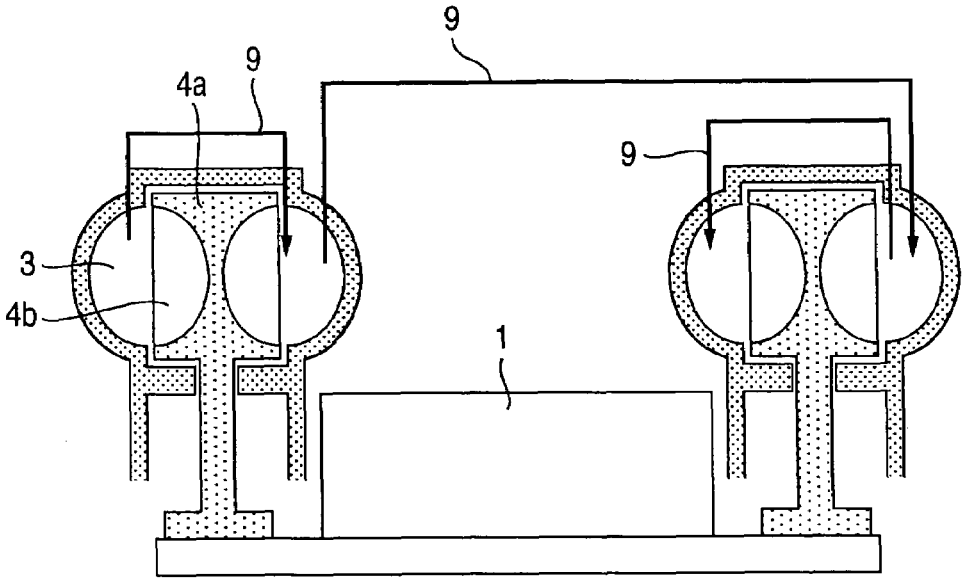
FIG. 13 is a cross sectional view of a typical cross sectional view of the vane wheels used for an embodiment of the vortex flow blower as seen in C direction in FIG. 4.
Figure 14:
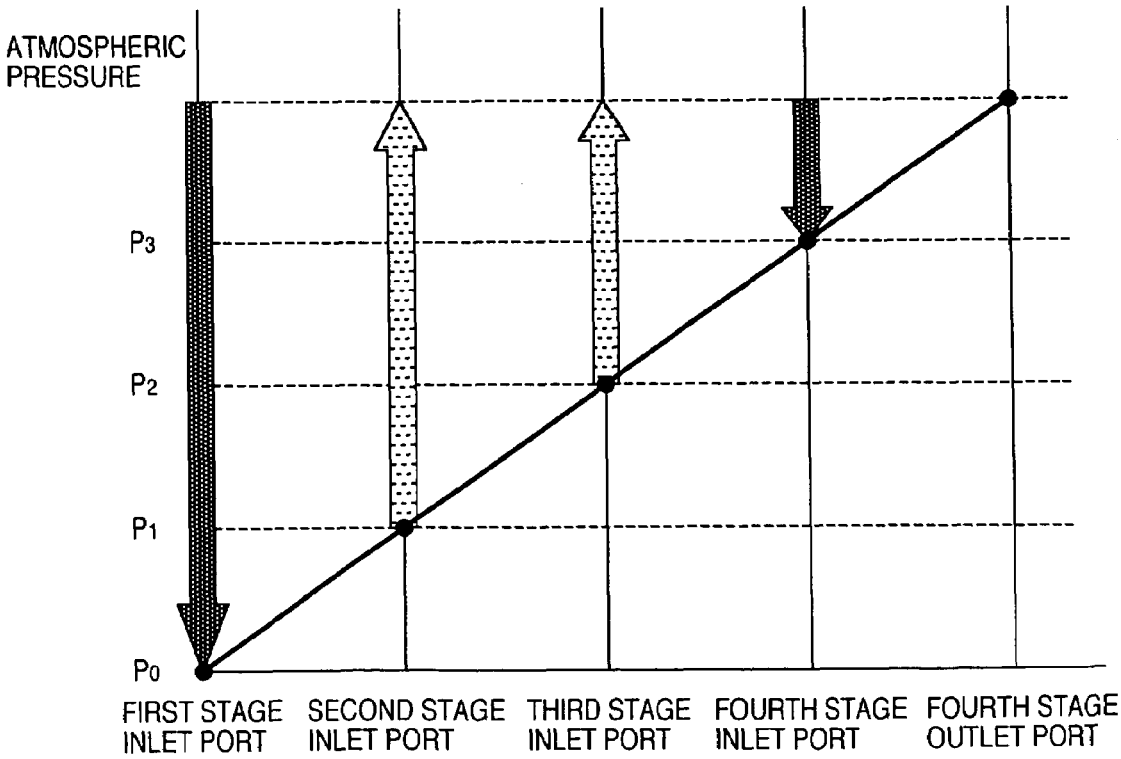
FIG. 14 is a view for explaining physically FIG. 13.
Figure 15:
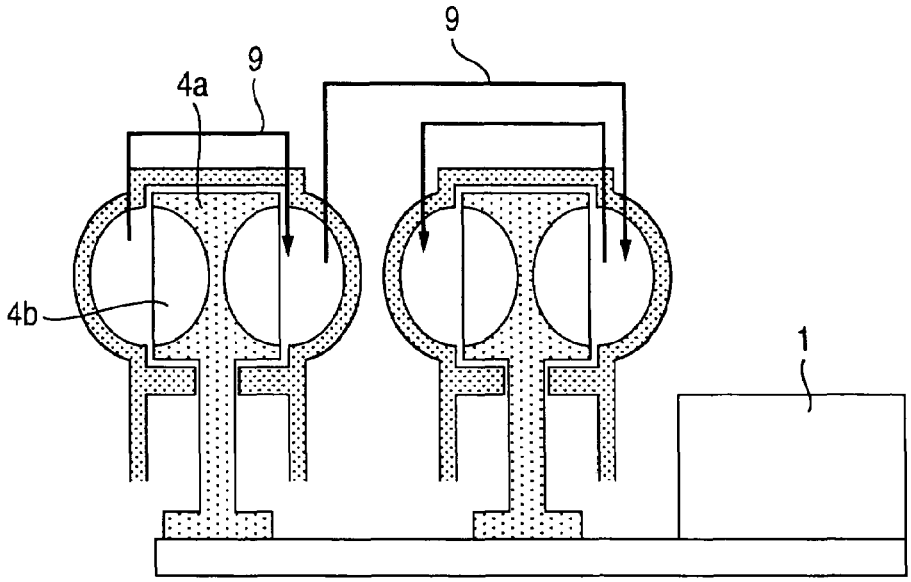
FIG. 15 is a view for explaining an embodiment of the invention as an explanation view of a typical cross section of the vane wheels used for the embodiment of the vortex flow blower of multistage as seen in C direction in FIG. 4.

FIGS. 13 and 14 show another embodiment for making a total amount of the thrust forces applied to the rotary shaft 11 of the blower zero. In FIG. 13, the electric motor 1 is arranged between the two vane wheels, and the arrangement of the introduction paths 9 makes the thrust force zero. Further, in this embodiment, since the rotary shaft 11 may be shortened, the structure of the multistage vortex flow blower connected directly to the electric motor is simplified. In FIG. 14, the electric motor 1 is arranged similarly to the embodiment of FIG. 2 at an opposite side of the multistage vortex flow blower so that the arrangement of the introduction paths 9 makes the thrust force zero.

Figure 16:
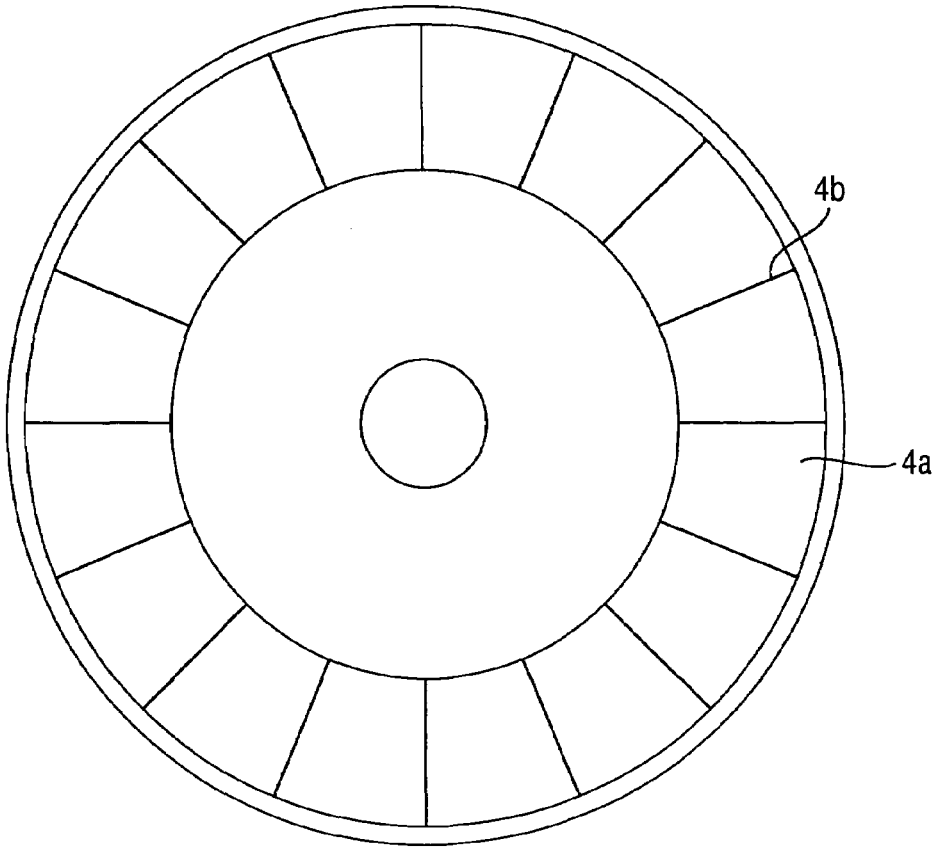
FIG. 16 is a view for explaining an embodiment as explanation view of the blades radially arranged on the shaft to form a vane wheel of cup type blade casing as a half of circular or elliptic shape.

FIG. 16 is another embodiment in which the shape of the vane wheel is changed. From FIG. 16, the blades 4*b* of the vane wheel with the cup shape blade casing are radially arranged with respect to the shaft.

Figure 17:
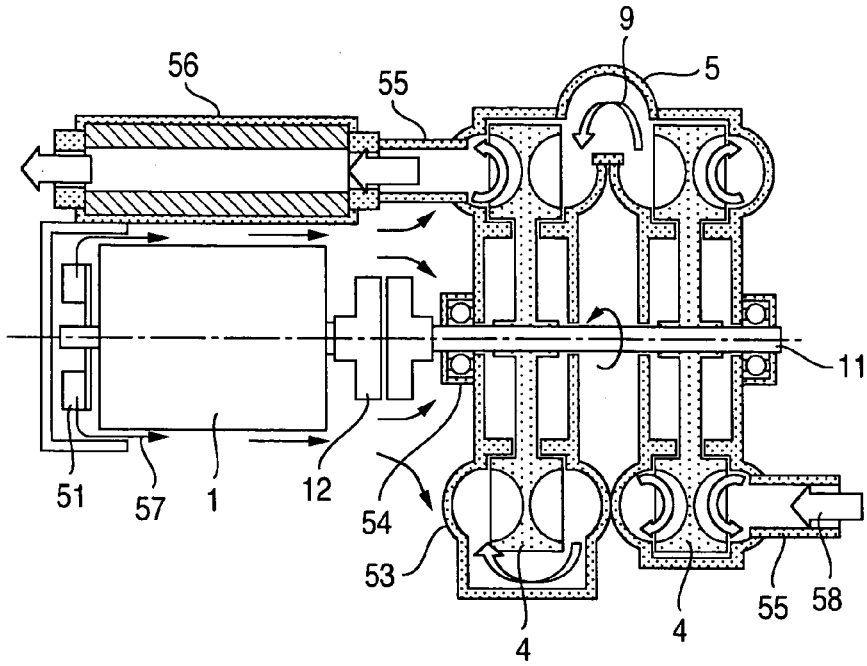
FIG. 17 is a cross sectional view of an embodiment in which a final pressurizing stage and a discharge port are arranged at an electric motor side.

Another embodiment of the invention is shown in FIG. 17.

Figure 18:
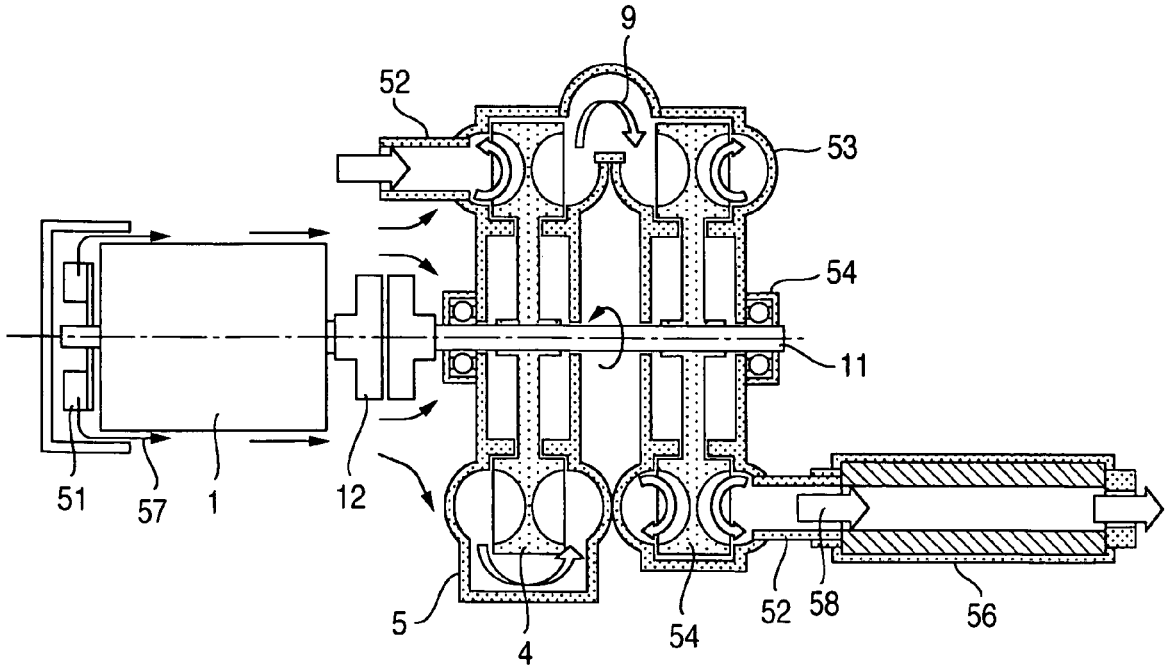
FIG. 18 is a cross sectional view showing an exhaust silencer in FIG. 2.

FIG. 17 is a view for explaining a structure in cross section for four stages pressurizing by two of the vane wheels of the embodiment of the multistage vortex flow blower, and FIG. 18 shows the structure in cross section of FIG. 2.

In FIG. 17, a rotating force is transmitted from the electric motor 1 through the driving force transmitting part 12 to the blower part 15. FIG. 17 is differentiated from FIG. 18 by that the final pressurizing stage 53 of the blower part 15 is arranged at a side of the blower part 15 connected to the electric motor 1, and the fluid 58 passing through the blower part is discharged from an outlet port to a side of the electric motor 1. An intake port 58 and the first pressurizing stage of the blower part 15 are arranged at a side opposite to the electric motor 1 and the driving force transmitting part 12 of the blower part 15.

As shown in FIG. 17, a fan 51 for cooling the electric motor 1 is arranged at a side of the electric motor 1 opposite to a driving shaft thereof so that a cooling wind 57 from the fan 51 reaches not only an outer periphery of the electric motor 1 but also the driving force transmitting part 12, a bearing portion at loading side, the final pressurizing stage of the blower part 15 and the discharge port 52 to be cooled by the cooling wind 57.

By rotationally driving the blower part 15 with the rotating force of the electric motor 1, the fluid is taken in from the intake port 55 of the blower part to be pressurized by each of the pressurizing stages through the vane wheels and stationary introduction paths 9, and is output from the discharge port 52.

In this process, since the vortex blower generates a vortex flow in the vane wheels with utilizing a frictional force of the fluid to be pressurized, a temperature increase of the fluid 58 in the blower and a temperature increase of the final pressurizing stage and bearing 54 at loading side are great so that a service life of grease in the bearing 54 is shortened, and a material strength of the casing 5 is deteriorated by the increase of temperature.

Further, when combinations of the vane wheels and stationary flow paths are connected to form the multistage, since the length of the rotary shaft of the blower part for supporting and rotating the vane wheels is increased, it may be connected to the driving shaft of driving equipment such as the electric motor through the driving force transmitting part such as the coupling.

In this case, the blower part including the casing 5 is heated to cause a difference in thermal expansion among the rotary shaft of the blower part, the driving shaft of the driving equipment and the driving force transmitting part or the like connecting them so that a problem occurs. It is estimated that for avoiding the problem, dimensional accuracy on each part when designing, arrangement, connecting mechanism and structure probably need to be complicated.

In contrast, by the structure of FIG. 17, the circumference of the final pressurizing stage 53, discharge port 52 and bearing 54 at loading side of the blower part 54 are cooled by the fan 51, so that a cooling performance for the final pressurizing stage 53 and bearing 54 at loading side are improved to solve the above mentioned problem or the like. By this structure, a cooling wind 57 of the electric motor 57 is utilized without using another cooling fan for limited use.

Further, the temperature decrease in this embodiment causes a decrease of T1 in the above formula (1) to increase the pressure ratio P2/P1. In other words, the temperature decrease in this embodiment improves the pressure ratio in comparison with the conventional structure.

Incidentally, a silencer 56 for decreasing a sound from the blower part 15 discharged from the discharge port 52 may be arranged in a space between the electric motor 1 and a mounting part as shown in FIG. 17. If the space is an unnecessary space as a so-called dead space, an equipment including the electric motor 1 and blower part 14 with a compact design and arrangement superior to FIG. 18 can be provided.

Further, in the structure of FIG. 17, the discharge port 52 of the blower part 15 and the silencer 56 can be arranged closer to each other in comparison with the conventional art so that a length of pipe connecting the discharge port 52 of the blower part 15 and the silencer 56 to each other can be decreased in comparison with the conventional art. The decrease in length of the pipe causes a decrease of resistance loss in the pipe in comparison with the conventional art to be effective for an improvement in efficiency of the equipment.

But, when the silencer 56 is mounted on the intake 55, it may be arranged in the space between the electric motor 1 and the mounting part as shown in FIG. 17.

The sound generated by the blower part may be effectively reduced if a temperature of the silencer 56 is kept within a predetermined temperature range by arranging the silencer 56 in the space between the electric motor 1 and the mounting part to enable the silencer to be air-cooled by the cooling wind from the fan 51. A major part of the sound generated by the blower including the vane wheel is a pressure interference sound of a frequency as a product of a number of vanes of the vane wheel 4 and a rotational frequency, and a resonance silencer utilizing a wave length is effective for absorbing the sound of this specific frequency. But, since the vortex flow blower causes the great temperature increase and the temperature varies in accordance with the obtained pressure, the wave length is changed to decrease the effect of the resonance silencer. If the silencer 56 is cooled to be kept within the predetermined temperature range as described above, a change of the wave length can be kept within a certain range to keep the sound absorbing effect of the resonance silencer constant.

Although the blower part 15 includes a plurality of combinations of the vane wheels and stationary flow paths as described and shown in the drawing as the embodiment of FIG. 17, as a matter of course, it may includes single stage to bring the invention into effect.

In the multistage vortex flow blower as the embodiments of the invention enabling the single vane wheel to perform the two stages pressurizing, an increase of the efficiency caused by further increase of generated pressure and further improvement of the cooling performance and the simplified sealing structure can be provided.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A blower to be driven by a motor to feed a gas, comprising:

a vane wheel including a pair of grooves extending circularly to surround a rotational axis of the vane wheel and opening in respective axial directions opposite to each other, and blades extending in a radial direction of the vane wheel in each of the grooves to partition the each of the grooves in a circumferential direction of the vane wheel, and a casing on which the vane wheel is supported in a rotatable manner and which includes a pair of stationary flow paths opening in the axial directions respectively and extending in the circumferential direction to face to the grooves respectively so that the gas urged in the grooves is capable of flowing in the circumferential direction in the stationary flow paths, a guide flow path extending in the axial directions to fluidly communicate with both of the stationary flow paths to enable the gas to flow from one of the stationary flow paths to the other one of the stationary flow paths so that the gas urged by one of the grooves is enabled to be further urged by the other one of the grooves, an inlet port for introducing the gas into the one of the stationary flow paths facing to the one of the grooves and an outlet port for discharging the gas out of the other one of the stationary flow paths facing to the other one of the grooves.

2. The blower according to claim 1, wherein the vane wheel has outer peripheral surfaces each of which overlaps corresponding one of the grooves as seen in the radial direction and faces to the casing in the radial direction to form a close clearance between each of the peripheral surfaces and the casing so that the gas is restrained by the close clearance from flowing along the each of the peripheral surfaces in one of the axial directions from the other one of the stationary flow paths toward the one of the stationary flow paths while the vane wheel is enabled to rotate with respect to the casing.

3. The blower according to claim 1, wherein the vane wheel has outer peripheral surfaces each of which overlaps corresponding one of the grooves as seen in the radial direction and faces to the casing in the radial direction to form the guide flow path between each of the peripheral surfaces and the casing so that the gas is enabled by the guide flow path to flow along the each of the outer peripheral surfaces in one of the axial directions from the one of the stationary flow paths toward the other one of the stationary flow paths.

4. The blower according to claim 1, wherein the vane wheel has outer peripheral surfaces each of which overlaps corresponding one of the grooves as seen in the radial direction and faces to the casing in the radial direction, and the outer peripheral surfaces form a common cylindrical shape.

5. The blower according to claim 4, wherein the common cylindrical shape has a constant outer diameter over its entire axial length.

6. The blower according to claim 1, wherein the vane wheel is arranged to position the other one of the grooves between the motor and the one of the grooves in the axial directions, and the motor has a rotary fan to generate an air flow in one of the axial directions from the other one of the grooves toward the one of the grooves.

7. The blower according to claim 6, wherein the casing has a bearing for supporting the vane wheel on the casing in a rotatable manner, and the bearing is arranged between the motor and the vane wheel in the axial directions.

8. The blower according to claim 1, wherein the motor has a rotary fan to generate an air flow in one of the axial directions from the motor toward the vane wheel, the casing includes an exhaust silencer connected to the outlet port to absorb sound from the gas discharged from the outlet port, and the exhaust silencer is arranged to be adjacent to the motor.

9. The blower according to claim 8, wherein the exhaust silencer is a resonance silencer.

10. The blower according to claim 8, wherein at least a part of the exhaust silencer is arranged to overlap at least a part of the motor as seen in a direction perpendicular the axial directions and overlap at least a part of the casing as seen in a direction parallel to the axial directions.

11. The blower according to claim 1, wherein a flow passage is defined by the one of the grooves and the one of the stationary flow paths to pressurize the gas in the flow passage by rotating the vane wheel, and a cross sectional area of the flow passage along an imaginary plane along which the rotational axis of the vane wheel extends is smaller than a cross sectional area of the guide flow path as seen in the axial directions to enable the gas pressurized in the flow passage to expand adiabatically in the guide flow path so that a temperature of the gas to be taken into the other one of the stationary flow paths decreases in the guide flow path.

12. The blower according to claim 1, wherein an effective cross sectional area for gas flow through the one of the stationary flow paths facing to the one of the grooves and an effective cross sectional area for gas flow through an outlet port of the one of the stationary flow paths are smaller than an effective cross sectional area for gas flow through the guide flow path to enable the gas pressurized by the one of the grooves to expand adiabatically in the guide flow path so that a temperature of the gas to be taken into the other one of the stationary flow paths decreases in the guide flow path.

* * * * *